US005582036A

United States Patent [19]

Drnevich et al.

[11] Patent Number: 5,582,036

[45] Date of Patent: Dec. 10, 1996

[54] CRYOGENIC AIR SEPARATION BLAST FURNACE SYSTEM

[75] Inventors: Raymond F. Drnevich, Clarence Center, N.Y.; Craig S. LaForce, Whitehouse Station, N.J.; Gerald A. Paolino, Lancaster; Neil M. Prosser, Lockport, both of N.Y.

[73] Assignee: Praxair Technology, Inc., Danbury, Conn.

[21] Appl. No.: 521,497

[22] Filed: Aug. 30, 1995

[51] Int. Cl.[6] ..... F25J 3/00

[52] U.S. Cl. ..... 62/656; 60/39.12; 62/915

[58] Field of Search ..... 62/646, 654, 915; 60/39.12

[56] References Cited

U.S. PATENT DOCUMENTS

| | | | |
|---|---|---|---|
| 4,022,030 | 5/1977 | Brugerolle | 62/30 |
| 4,250,704 | 2/1981 | Bruckner et al. | 60/39.12 |
| 5,233,838 | 8/1993 | Howard | 62/25 |
| 5,244,489 | 9/1993 | Grenier | 75/466 |
| 5,245,832 | 9/1993 | Roberts | 62/24 |
| 5,268,019 | 12/1993 | Rathbone | 75/466 |
| 5,291,737 | 3/1994 | Camberlein et al. | 62/22 |
| 5,317,862 | 6/1994 | Rathbone | 60/39.05 |
| 5,349,824 | 9/1994 | Ha et al. | 62/24 |
| 5,421,166 | 6/1995 | Allam et al. | 62/915 |

*Primary Examiner*—Ronald C. Capossela
*Attorney, Agent, or Firm*—Stanley Ktorides

[57] ABSTRACT

A system which integrates a cryogenic air separation plant with a blast furnace system enabling efficient oxygen enrichment of the blast air, and, if desired, production of additional higher purity oxygen.

10 Claims, 3 Drawing Sheets

CRYOGENIC AIR SEPARATION BLAST FURNACE SYSTEM

TECHNICAL FIELD

This invention relates generally to cryogenic rectification and more particularly to cryogenic air separation employed with a blast furnace system.

BACKGROUND ART

The operators of blast furnaces have been switching to powdered coal injection to reduce the amount of coke necessary for the production of iron from iron ore. With powdered coal injection the air to the blast furnace, known as the blast air, must be enriched with oxygen in order to maintain the blast furnace production rate. A conventional method for enriching the blast air is to mix it with some high purity oxygen, having a purity of about 99.5 mole percent, which is generally available from an air separation which produces the oxygen for use in steel refining operations. Alternatively, lower purity oxygen may be employed to enrich the blast air. In either case, the cost of the oxygen is an important consideration in the economics of the production of the hot metal from the blast furnace.

Accordingly, it is an object of this invention to provide a system for enriching the blast air to a blast furnace with oxygen which is more efficient than heretofore available systems.

SUMMARY OF THE INVENTION

The above and other objects which will become apparent to those skilled in the art upon a reading of this disclosure are attained by the present invention one aspect of which is:

A method for producing oxygen-enriched blast air comprising:

(A) compressing air to produce blast air;

(B) dividing the blast air into a blast air portion and a feed air portion;

(C) at least partially condensing the feed air portion and passing the resulting feed air into a double column comprising a higher pressure column and a lower pressure column;

(D) producing intermediate oxygen by cryogenic rectification within the double column and passing intermediate oxygen from the double column into a side column;

(E) separating intermediate oxygen by cryogenic rectification within the side column into oxygen product fluid, having an oxygen concentration which exceeds that of the intermediate oxygen, and remaining vapor;

(F) passing remaining vapor from the side column into the lower pressure column of the double column;

(G) vaporizing some oxygen product fluid by indirect heat exchange with the feed air portion to carry out the said at least partial condensation of the feed air portion; and (H) withdrawing oxygen product fluid from the side column and combining withdrawn oxygen product fluid with the blast air portion to produce oxygen-enriched blast air.

Another aspect of the invention is:

Apparatus for enriching blast air with oxygen comprising:

(A) a blast air blower having an output line;

(B) a side column having a bottom reboiler;

(C) a double column comprising a first column and a second column;

(D) means for withdrawing column feed from the output line, and passing the column feed to the bottom reboiler and from the bottom reboiler into the first column;

(E) means for passing fluid from the lower portion of the second column into the side column;

(F) means for passing fluid from the upper portion of the side column into the second column;

(G) means for withdrawing enriching fluid from the side column; and (H) means for passing enriching fluid from the side column into the output line at a point downstream of the point where column feed is withdrawn from the output line.

A further aspect of the invention is:

A method for producing oxygen-enriched blast air comprising:

(A) compressing air to produce blast air;

(B) dividing the blast air into a blast air portion and a feed air portion;

(C) at least partially condensing the feed air portion and passing the resulting feed air into a double column comprising a higher pressure column and a lower pressure column;

(D) producing lower purity oxygen by cryogenic rectification within the double column and passing first lower purity oxygen from the double column into a side column;

(E) separating first lower purity oxygen by cryogenic rectification within the side column into higher purity oxygen fluid, having an oxygen concentration which exceeds that of the first lower purity oxygen, and remaining vapor;

(F) passing remaining vapor from the side column into the lower pressure column of the double column;

(G) vaporizing some higher purity oxygen fluid by indirect heat exchange with the feed air portion to carry out the said at least partial condensation of the feed air portion; and (H) withdrawing second lower purity oxygen from the double column and combining withdrawn second lower purity oxygen with the blast air portion to produce oxygen-enriched blast air.

Yet another aspect of the invention is:

Apparatus for enriching blast air with oxygen comprising:

(A) a blast air blower having an output line;

(B) a side column having a bottom reboiler;

(C) a double column comprising a first column and a second column;

(D) means for withdrawing column feed from the output line, and passing the column feed to the bottom reboiler and from the bottom reboiler into the first column;

(E) means for passing fluid from the lower portion of the second column into the side column;

(F) means for passing fluid from the upper portion of the side column into the second column;

(G) means for withdrawing enriching fluid from the second column; and (H) means for passing enriching fluid from the second column into the output line at a point downstream of the point where column feed is withdrawn from the output line.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "bottom reboiler" means a heat exchange device which generates column upflow vapor from column bottom liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "feed air" means a mixture comprising primarily nitrogen and oxygen, such as ambient air.

As used herein the term "blast furnace" means a furnace, generally used for the reduction of iron ore, wherein combustion is forced by a current of oxidant, i.e. the blast air, under pressure.

As used herein the term "blast air blower" means a turbocompressor that provides compressed feed air for blast furnace operation and for a cryogenic air separation plant.

Figure 1:
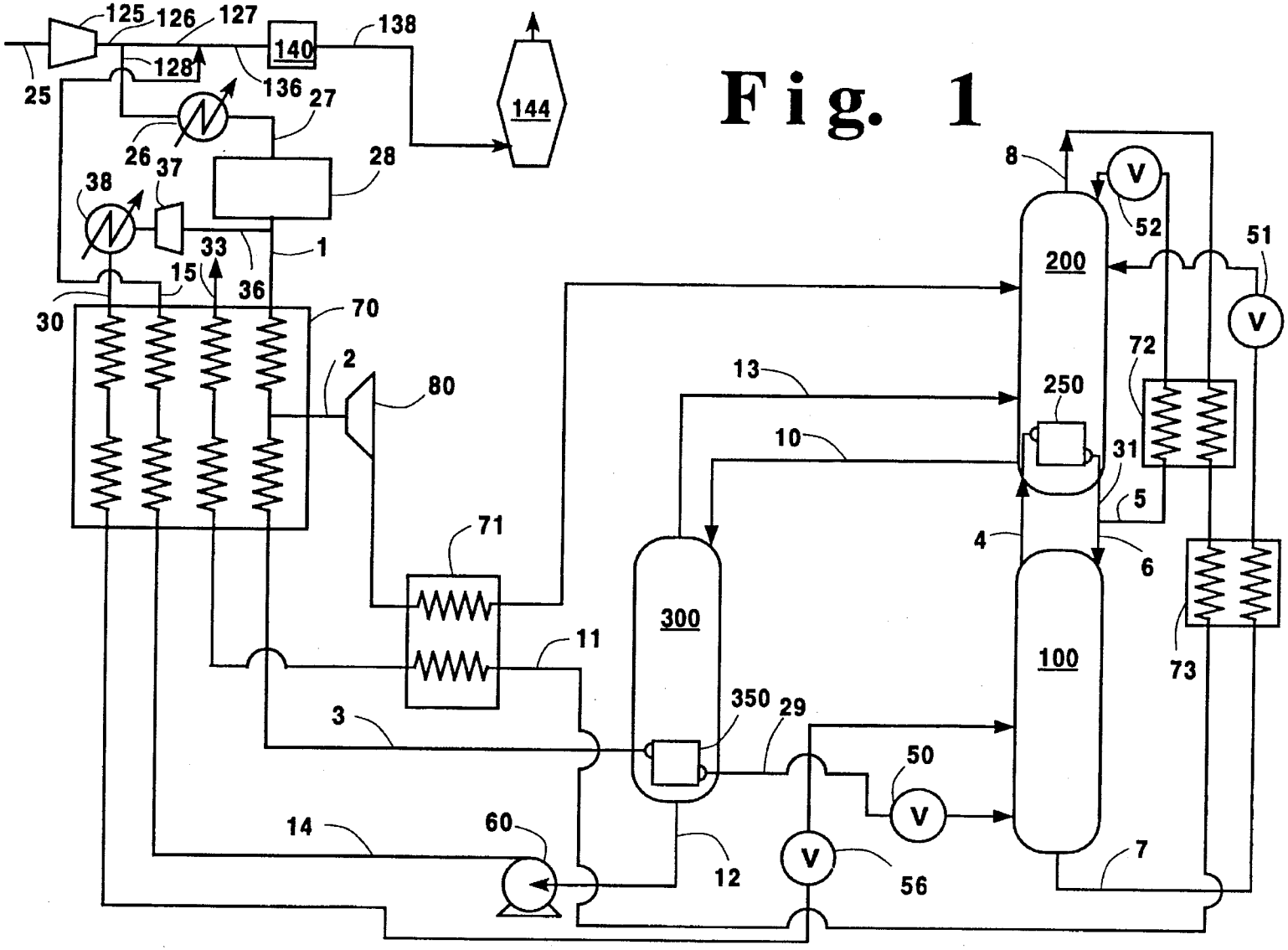
FIG. 1 is a schematic representation of one preferred embodiment of the invention.

The numerals in the Drawings are the same for the common elements.

DETAILED DESCRIPTION

The invention comprises the integration of a cryogenic air separation plant with a blast furnace system. In the practice of the invention, the base load feed air compressor, which is a standard item of conventional cryogenic air separation plants, is eliminated. The feed air to the cryogenic air separation plant is taken from the blast air blower of the blast furnace system and enriching oxygen from the plant is passed into a downstream portion of the blast air train. The invention may also be used to produce another oxygen product at a higher purity than the enriching oxygen used with the blast air.

The invention will be described in detail with reference to the Drawings.

Referring now to FIG. 1, air 25 is compressed in blast air blower 125 to produce blast air 126 which is passed out of blower 125 in the blast air blower output line which runs from the blower ultimately to the blast furnace. Blast air 126 has a pressure within the range of from 35 to 100 pounds per square inch absolute (psia). The blast air is divided into blast air portion 127, comprising from 50 to 90 percent of blast air 126, and feed air portion 128, comprising from 10 to 50 percent of blast air 126. The feed air portion is withdrawn from the output line as the column feed. If desired, additional compressed air from an auxiliary compressor may be added to feed air portion 128. Feed air portion 128 is then cooled by passage through cooler 26 to remove heat of compression. Thereafter the pressurized feed air 27 is cleaned of high boiling impurities, such as water vapor and carbon dioxide, by passage through purifier 28 and resulting feed air stream 1 is cooled by indirect heat exchange with return streams in main heat exchanger 70. A minor portion 2, generally comprising from 2 to 20 percent of feed air portion 128, is turboexpanded through turboexpander 80 to generate refrigeration, further cooled by passage through heat exchanger 71 and passed into lower pressure column 200. Another portion 36 of feed air stream 1, generally comprising from 15 to 45 percent of feed air portion 128, is taken from stream 1 as a sidestream upstream of main heat exchanger 70, compressed through compressed 37, cooled through cooler 38, at least partially condensed, such as through main heat exchanger 70, and passed as stream 30 through valve 56 into higher pressure column 100 at or above the point where main feed air stream 29 is passed into column 100.

Portion 3, generally comprising from 35 to 83 percent of the feed air portion, is passed through bottom reboiler 350 which is usually located within side column 300 in the lower portion of this column. Within bottom reboiler 350 the compressed feed air is at least partially condensed and thereafter the resulting feed air stream 29 is passed through valve 50 and into higher pressure column 100.

Higher pressure column 100 is the first or higher pressure column of the double column which also comprises second or lower pressure column 200. Higher pressure column 100 operates at a pressure generally within the range of from 30 to 95 psia. Within higher pressure column 100 the feed air is separated by cryogenic rectification into nitrogen-enriched vapor and oxygen-enriched liquid. Nitrogen-enriched vapor is passed in stream 4 to main condenser 250 wherein it is condensed by indirect heat exchange with lower pressure column 200 bottom liquid. Resulting nitrogen-enriched liquid 31 is divided into streams 6 and 5. Stream 6 is passed into column 100 as reflux and stream 5 is cooled by passage through heat exchanger 72 and passed through valve 52 and into column 200 as reflux. Oxygen-enriched liquid is withdrawn from the lower portion of column 100 as stream 7, cooled by passage through heat exchanger 73 and then passed through valve 51 and into column 200. Column 200 operates at a pressure less than that of column 100 and generally within the range of from 16 to 25 psia. Main condenser 250 can be the usual thermosyphon unit, or can be a once through liquid flow unit, or can be a downflow liquid flow arrangement.

Within lower pressure column 200 the various feeds into this column are separated by cryogenic rectification into nitrogen-rich vapor and intermediate liquid oxygen. Nitrogen-rich vapor is withdrawn from the upper portion of column 200 as stream 8, warmed by passage through heat exchangers 72, 73, 71 and 70, and removed from the system as stream 33 which may be released to the atmosphere as waste or may be recovered in whole or in part. Stream 33 will generally have an oxygen concentration within the range of from 0.1 to 2.5 mole percent with the remainder essentially all nitrogen. Intermediate oxygen liquid, having an oxygen concentration within the range from 50 to 85 mole percent, is withdrawn from the lower portion of second or lower pressure column 200 and passed as stream 10 into the upper portion of side column 300.

Side column 300 operates at a pressure which is similar to that of lower pressure column 200 and generally within the range of from 16 to 25 psia. Within side column 300 the descending intermediate liquid oxygen is upgraded by cryogenic rectification against upflowing vapor into oxygen product fluid and remaining vapor. Some or all of the remaining vapor, generally having an oxygen concentration within the range of from 20 to 65 mole percent and a nitrogen concentration within the range of from 30 to 80 mole percent, is passed in stream 13 from the upper portion of side column 300 into lower pressure column 200.

The oxygen product fluid, having an oxygen concentration which exceeds that of the intermediate oxygen liquid and is within the range of from 70 to 99 mole percent, collects as liquid in the lower portion of side column 300 and at least a portion thereof is vaporized by indirect heat exchange against the condensing compressed feed air portion in bottom reboiler 350 which may be of the conventional thermosyphon type or may be a once through or downflow type unit. This vaporization serves to generate the upflowing vapor for the separation of the intermediate liquid oxygen within side column 300. The oxygen product fluid, which is used as the enriching fluid for the blast air, may be withdrawn from column 300 as gas and/or liquid.

In the embodiment illustrated in FIG. 1, the oxygen product fluid is withdrawn from column 300 as liquid. Oxygen product liquid stream 12 is increased in pressure by means of liquid pump 60 and pressurized liquid stream 14 is vaporized, such as by passage through main heat exchanger 70, to produce elevated pressure oxygen product gas stream 15. Generally, the elevated pressure oxygen product gas will have a pressure within the range of from 30 to 200 psia. Depending upon the heat exchanger design requirements, it may be preferred that the boiling of stream 14 against condensing stream 30 be carried out in a separate heat exchanger (not shown) located between liquid pump 60 and main heat exchanger 70.

Oxygen product fluid stream 15 is then combined with blast air portion 127 in the output line downstream of the point where the blast air is divided into blast air portion and feed air portion, i.e. a point downstream of the point where column feed is withdrawn from the output line, to form oxygen-enriched blast air 136 having an oxygen concentration within the range of from 21 to 40 mole percent. Stream 136 is heated in blast furnace stoves 140 to a temperature generally within the range of from 1500° to 2500° F. and resulting heated oxygen-enriched blast air 138 is passed on to blast furnace 144.

Figure 2:
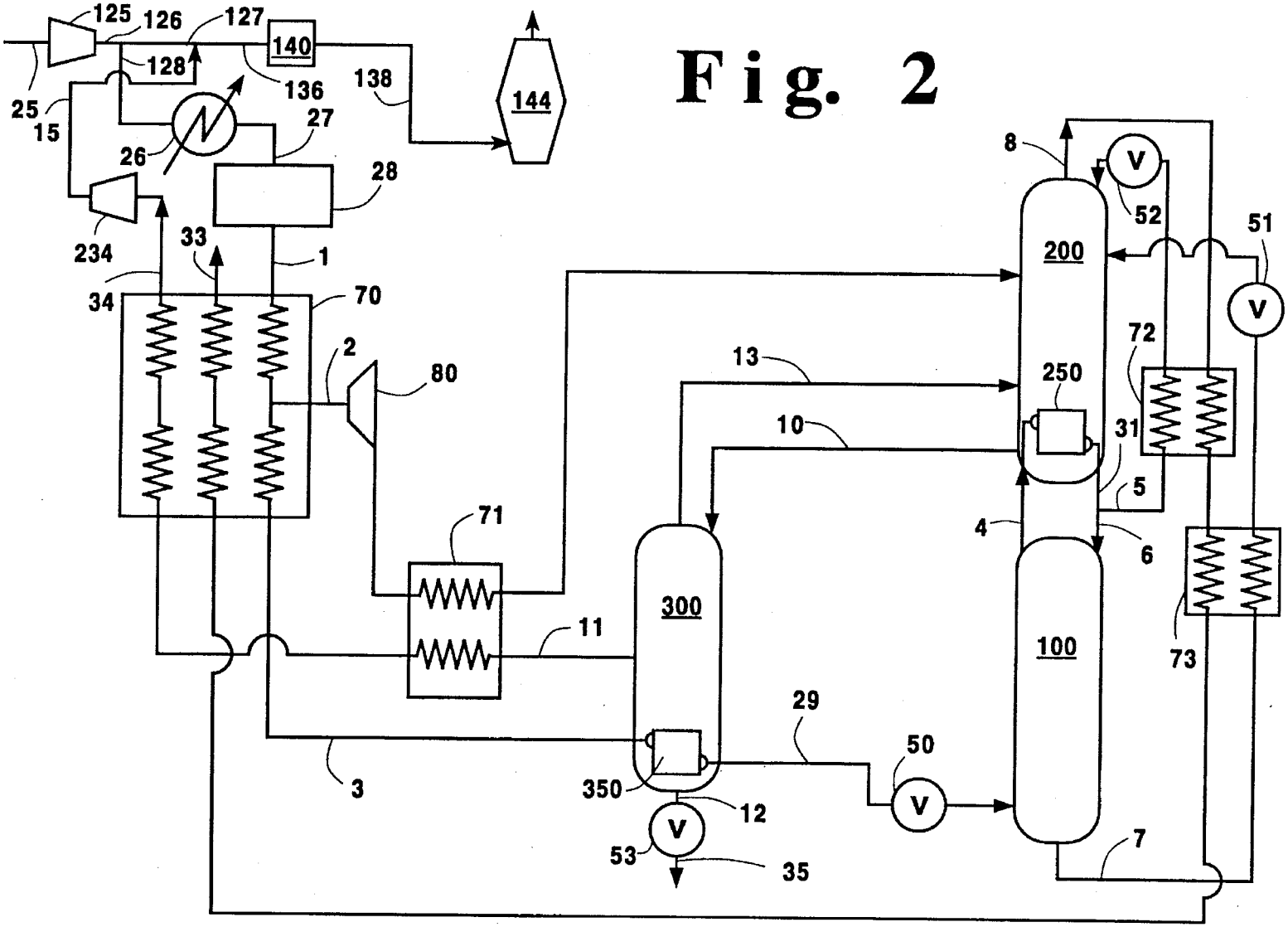
FIG. 2 is a schematic representation of another embodiment of the invention.

FIG. 2 illustrates another embodiment of the invention wherein oxygen product fluid used to enrich the blast air is withdrawn from column 300 as gas. In the embodiment illustrated in FIG. 2 sidestream 36 is not employed as there is no need to vaporize oxygen product fluid. The elements of this embodiment which are common with those of the embodiment illustrated in FIG. 1 will not be described again in detail.

Referring now to FIG. 2, oxygen product fluid is withdrawn as gas from column 300 in stream 11 warmed by passage through heat exchangers 71 and 70 to form stream 34, which is compressed by passage through compressor 234 to form pressurized oxygen product fluid stream 15, which is then further processed as described above. In this embodiment, if desired, some oxygen product fluid may be withdrawn from column 300 as liquid in stream 12, passed through valve 53 and recovered as oxygen product liquid in stream 35.

Figure 3:
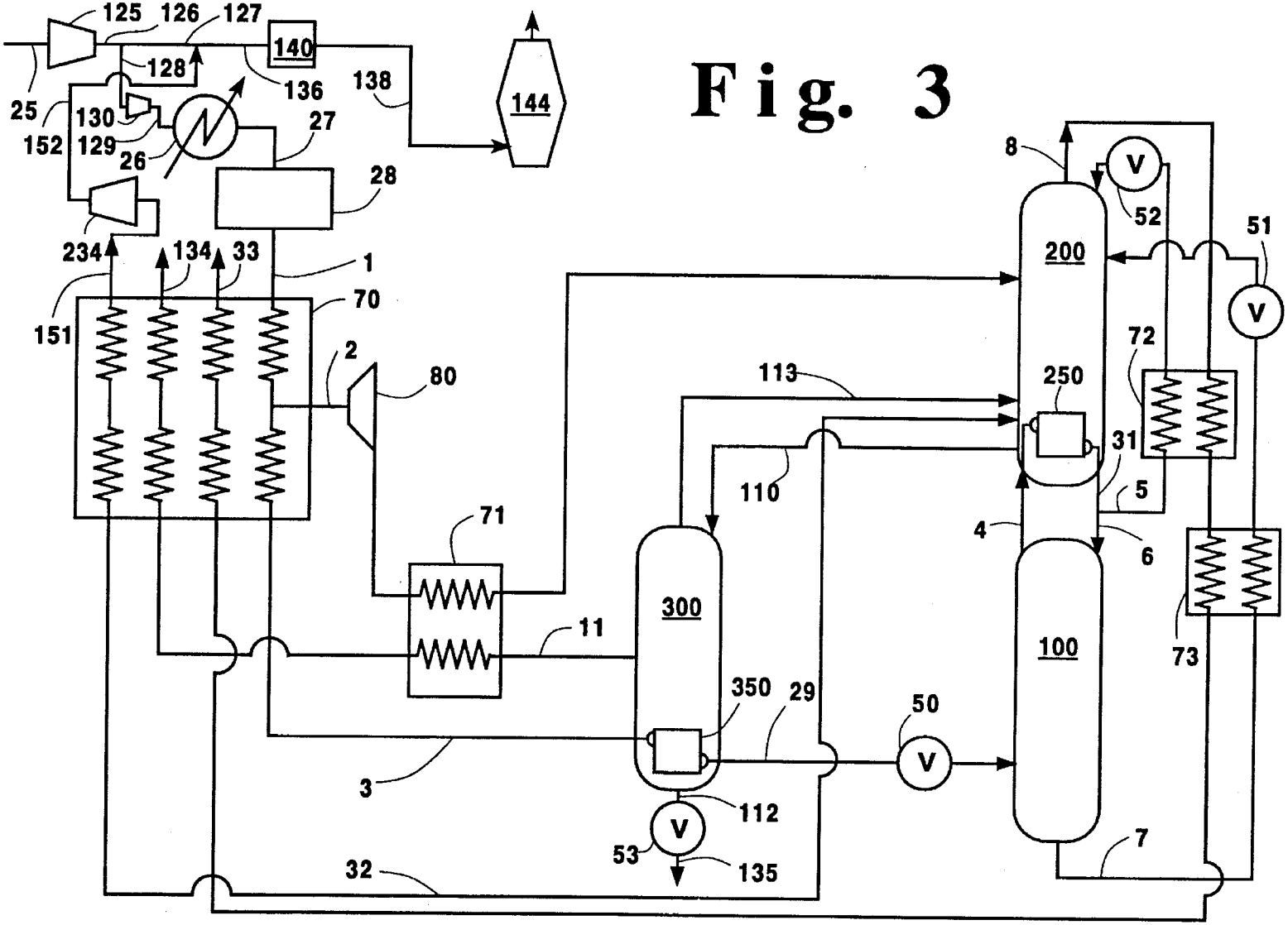
FIG. 3 is a schematic representation of another preferred embodiment of the invention wherein lower purity oxygen from the lower pressure column is used to enrich the blast air.

FIG. 3 illustrates another embodiment of the invention wherein the enriching fluid for the blast air is taken from the lower pressure column. In this embodiment the oxygen fluid produced in the lower portion of the lower pressure column is lower purity oxygen having an oxygen concentration within the range of from 60 to 99 mole percent, and the oxygen fluid produced in the side column is higher purity oxygen having an oxygen concentration which exceeds that of the lower purity oxygen and is within the range of from 90 to 99.9 mole percent. In this embodiment feed air portion 128 is further compressed by passage through compressor 130 to a pressure within the range of from 60 to 120 psia, and resulting further pressurized stream 129 is passed to cooler 26 and further processed as discussed above. In this embodiment, higher pressure column 100 may operate at a higher pressure than in the previously described embodiments. The elements of the embodiment illustrated in FIG. 3 which are common with those of one of the earlier described embodiments will not be described again in detail.

Referring now to FIG. 3, first lower purity oxygen stream 110 is passed from the lower portion of column 20 into the upper portion of side column 300 wherein it is separated by cryogenic rectification into higher purity oxygen and remaining vapor. Higher purity oxygen liquid is used to condense feed air portion 3 in bottom reboiler 350. At least some of the remaining vapor is passed from side column 300 into lower pressure column 200 in stream 113. Higher purity oxygen may be recovered from side column 300 as gas and/or liquid. Higher purity oxygen gas may be withdrawn from column 300 as stream 111, warmed by passage through heat exchangers 71 and 70 and recovered as stream 134. Higher purity oxygen liquid may be withdrawn from column 300 as stream 112, passed through valve 53 and recovered as stream 135.

Second lower purity oxygen, which is used as the enriching fluid for the blast air, is withdrawn from the lower portion of column 200 in stream 150 and warmed by passage through main heat exchanger 70. Resulting stream 151 is compressed in compressor 234 to a pressure within the range of from 30 to 200 psia to form pressurized enriching stream 152, which is analogous to stream 15 of the embodiments illustrated in FIGS. 1 and 2, and is further processed as therewith described.

Now, by the use of this invention, one may efficiently integrate a cryogenic air separation plant with a blast furnace system to produce oxygen-enriched blast air. Although the invention has been described in detail with reference to certain preferred embodiments, those skilled in the art will recognize that there are other embodiments of the invention within the spirit and the scope of the claims.

I claim:

1. A method for producing oxygen-enriched blast air comprising:

(A) compressing air to produce blast air;

(B) dividing the blast air into a blast air portion and a feed air portion;

(C) at least partially condensing the feed air portion and passing the resulting feed air into a double column comprising a higher pressure column and a lower pressure column;

(D) producing intermediate oxygen by cryogenic rectification within the double column and passing intermediate oxygen from the double column into a side column;

(E) separating intermediate oxygen by cryogenic rectification within the side column into oxygen product fluid, having an oxygen concentration which exceeds that of the intermediate oxygen, and remaining vapor;

(F) passing remaining vapor from the side column into the lower pressure column of the double column;

(G) vaporizing some oxygen product fluid by indirect heat exchange with the feed air portion to carry out the said at least partial condensation of the feed air portion; and (H) withdrawing oxygen product fluid from the side column and combining withdrawn oxygen product fluid with the blast air portion to produce oxygen-enriched blast air.

2. The method of claim 1 wherein the oxygen product fluid is withdrawn from the side column as gas.

3. The method of claim 1 wherein oxygen product fluid is withdrawn from the side column as liquid, increased in pressure, and vaporized prior to combination with the blast air portion.

4. The method of claim 3 further comprising further compressing a side stream portion of the feed air portion, as least partially condensing the side stream portion, and passing the resulting side stream portion into the higher pressure column at a point which is at or above the point where the at least partially condensed feed air portion is passed into the double column.

5. Apparatus for enriching blast air with oxygen comprising:

(A) a blast air blower having an output line;

(B) a side column having a bottom reboiler;

(C) a double column comprising a first column and a second column;

(D) means for withdrawing column feed from the output line, and passing the column feed to the bottom reboiler and from the bottom reboiler into the first column;

(E) means for passing fluid from the lower portion of the second column into the side column;

(F) means for passing fluid from the upper portion of the side column into the second column;

(G) means for withdrawing enriching fluid from the side column; and (H) means for passing enriching fluid from the side column into the output line at a point downstream of the point where column feed is withdrawn from the output line.

6. The apparatus of claim 5 wherein the means for passing enriching fluid from the side column into the output line includes a liquid pump.

7. A method for producing oxygen-enriched blast air comprising:

(A) compressing air to produce blast air;

(B) dividing the blast air into a blast air portion and a feed air portion;

(C) at least partially condensing the feed air portion and passing the resulting feed air into a double column comprising a higher pressure column and a lower pressure column;

(D) producing lower purity oxygen by cryogenic rectification within the double column and passing first lower purity oxygen from the double column into a side column;

(E) separating first lower purity oxygen by cryogenic rectification within the side column into higher purity oxygen fluid, having an oxygen concentration which exceeds that of the first lower purity oxygen, and remaining vapor;

(F) passing remaining vapor from the side column into the lower pressure column of the double column;

(G) vaporizing some higher purity oxygen fluid by indirect heat exchange with the feed air portion to carry out the said at least partial condensation of the feed air portion; and (H) withdrawing second lower purity oxygen from the double column and combining withdrawn second lower purity oxygen with the blast air portion to produce oxygen-enriched blast air.

8. The method of claim 7 wherein the lower purity oxygen has an oxygen concentration within the range of from 60 to 99 mole percent and the higher purity oxygen has an oxygen concentration within the range of from 90 to 99.9 mole percent, further comprising recovering higher purity oxygen from the side column.

9. Apparatus for enriching blast air with oxygen comprising:

(A) a blast air blower having an output line;

(B) a side column having a bottom reboiler;

(C) a double column comprising a first column and a second column;

(D) means for withdrawing column feed from the output line, and passing the column feed to the bottom reboiler and from the bottom reboiler into the first column;

(E) means for passing fluid from the lower portion of the second column into the side column;

(F) means for passing fluid from the upper portion of the side column into the second column;

(G) means for withdrawing enriching fluid from the second column; and (H) means for passing enriching fluid from the second column into the output line at a point downstream of the point where column feed is withdrawn from the output line.

10. The apparatus of claim 9 further comprising means for recovering fluid from the side column.

* * * * *